United States Patent [19]

Suzuki et al.

[11] 4,358,247

[45] Nov. 9, 1982

[54] OIL COOLED COMPRESSOR

[75] Inventors: Toshitsugu Suzuki, Tokyo; Masayuki Tuchida, Yokohama, both of Japan

[73] Assignees: Hitachi, Ltd., Tokyo; Tokico, Ltd., Kanagawa, both of Japan

[21] Appl. No.: 162,792

[22] Filed: Jun. 25, 1980

[30] Foreign Application Priority Data

Jul. 10, 1979 [JP] Japan ..... 54-87331

[51] Int. Cl.[3] ..... F04B 49/06

[52] U.S. Cl. ..... 417/13; 417/19; 417/29; 417/32; 417/44; 417/295; 417/302

[58] Field of Search ..... 417/38, 13, 32, 44, 417/18, 19, 26, 29–31, 292, 302, 306, 295, 279, 316, 317, 281; 418/1, 84

[56] References Cited

U.S. PATENT DOCUMENTS 2,137,221 11/1938 Aikman ..... 417/13
3,411,313 11/1968 Brown et al. ..... 417/18 X
3,602,610 8/1971 Bloom ..... 417/295 X
3,788,776 1/1974 Post et al. ..... 417/295
4,227,862 10/1980 Andrew et al. ..... 417/12
4,289,461 9/1981 van Oorschot et al. ..... 418/DIG. 1

*Primary Examiner*—Carlton R. Croyle
*Assistant Examiner*—Edward Look
*Attorney, Agent, or Firm*—Wenderoth, Lind & Ponack

[57] ABSTRACT

An oil cooled compressor including a compressor member driven by a motor, an oil tank receiving oil therein and removing oil from the gas discharging out of the compressor member, an oil supplying device for supplying the oil in the oil tank into the compressor member, and a pressure responsive control device for controlling the operation of the compressor member. There are provided a first temperature detector detecting the temperature of the oil, a second temperature detector detecting the temperature of the gas, and a temperature responsive control device restricting the function of the pressure responsive control device in response to the temperatures detected by the first and second temperature detectors.

10 Claims, 4 Drawing Figures

23
3
4
3'
31
22
1''
1
1'
5
M
2
20
19
6
15
16
8
14
21
10
11
9
12
13
12
17
7
18

20a
25
25a
2a
24
25b
2b
2
M
2c
24
25c
21
25e
27
28
25d
30
29
19
23
26
31
3'

OIL COOLED COMPRESSOR

BACKGROUND OF THE INVENTION

This invention relates to improvements in oil cooled compressors of the kind wherein gas to be compressed, normally the atmospheric air, is drawn together with oil into a compressor member, and the oil acts to cool and lubricate the compressor member. The compressed gas discharged from the compressor member is introduced into an oil tank to separate the oil therefrom and is thereafter directed to a storage tank. The oil separated is cooled and is reused for cooling and lubricating the compressor member. When the pressure in the storage tank elevates to a predetermined maximum value, a pressure switch detects the pressure to open an electric circuit, thereby stopping a motor which drives the compressor. When the air in the storage tank has been consumed and the pressure therein decreases to a predetermined minimum value, the pressure switch closes to start the motor.

The compressed gas discharging out of the compressor member is usually at a high temperature and high humidity, thus, when the oil and the oil tank have not sufficiently been warmed as in the case just after the compressor is started, the compressed gas is cooled in the oil tank, thereby generating drain water which deteriorates the oil and generates rusts on metal parts. Consequently, the oil is preferably at a low temperature in view of the cooling, but it is necessary to maintain the oil at a relatively high temperature to prevent the generation of drain water. This relatively high temperature is determined in accordance with the dew point of the compressed gas and is higher than the room temperature by about 50° C. when the pressure of the compressed air are 8–9 $Kg/cm^2$. Conventionally, a temperature adjusting valve is interposed between the oil tank and an oil cooler, and the temperature adjusting valve and an oil inlet port of the compressor member is connected by a by-pass tube by-passing the oil cooler, thereby controlling the oil flow in the oil cooler in accordance with the oil temperature.

However, in such prior art devices, it requires a long time to elevate the oil temperature from a relatively low temperature such as the room temperature to a higher temperature, such as the temperature at the dew point of the compressed gas, which can suppress the generation of the drain water. Particularly, when the starting and the stopping of the motor are controlled by a pressure switch detecting the pressure in the storage tank, the operating time of the motor is solely controlled by the pressure and not by the oil temperature. Thus, the oil temperature does not always reach a desired minimum temperature.

It has been proposed to continuously operate the compressor member until the oil temperature elevates to the desired minimum temperature, which can suppress the generation of the drain water, while preventing the pressure of the compressed gas discharged from exceeding a predetermined pressure. Namely, the compressor is operated under an unloading operation, that is, a portion of the compressed gas is released by utilizing a release valve, thereby maintaining the pressure in the storage tank or in the discharge line within a predetermined pressure range. Such a range is called an oil temperature elevating operation range. The energy for operating the compressor in this manner is utilized to heat the oil.

However, in the prior art devices, the desired minimum oil temperature for suppressing the generation of the drain water has been determined without considering the effects of the room temperature. In particular, the desired minimum oil temperature has usually been determined to be 90° C. which corresponds to the expected maximum operating room temperature of 40° C. However, when the room temperature is assumed to be 20° C. the generation of the drain water will not be observed when the oil temperature has been elevated to 20+50=70° C., but the oil temperature elevating operation will be performed until the oil temperature is increased to 90° C. Thus the compressor will more that is required. Further, when the room temperature is sufficiently low, the absolute humidity of the air is very small and essentially no drain water will be generated and, therefore, the oil temperature elevating operation can essentially be omitted.

SUMMARY OF THE INVENTION

The present invention solves the problems aforementioned by providing two temperature detectors respectively detecting the temperature of the gas and oil to control the operation of the motor in addition to the prior art pressure responsive motor controlling device.

According to a preferred embodiment of the invention, the two temperature detectors constitute a thermocouple, and the electromotive force of the thermo-couple corresponding to the temperature difference between the gas and the oil is utilized to control the motor.

BRIEF DESCRIPTION OF THE DRAWINGS

The present invention will hereinafter be explained in detail with reference to the accompanying drawings exemplifying some embodiments of the invention, in which.

DETAILED DESCRIPTION OF THE PREFERRED EMBODIMENTS

Figure 1:
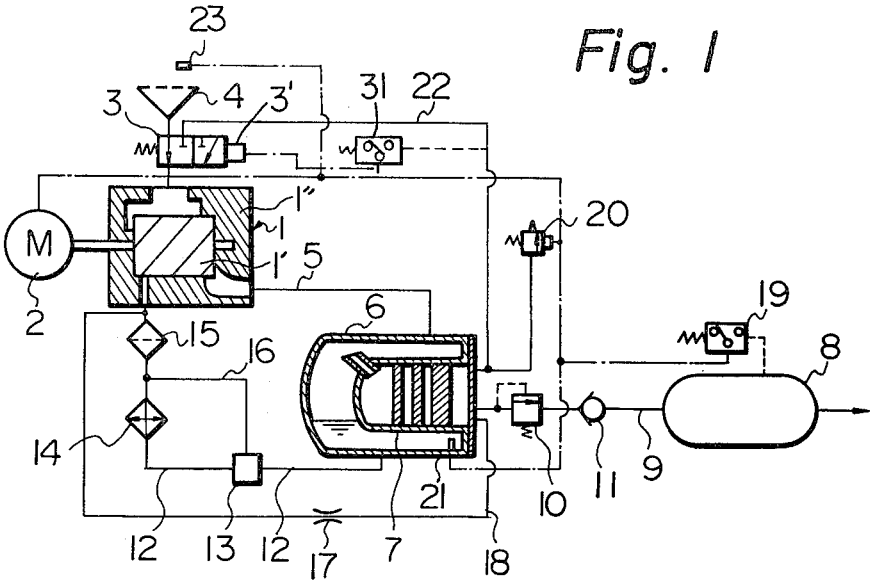
FIG. 1 is a schematic view of an oil cooled compressor according to the invention.

Referring to FIG. 1, the oil cooled compressor according to the invention comprises a compressor member 1 driven by an electric motor 2. The compressor may be of a screw type including intermeshing male and female rotors or of a vane type including a rotor having thereon a plurality of vanes. The compressor member 1 includes a casing or housing 1'' rotatably receiving therein the rotors or the rotor 1'. It will be understood that the compressor member 1 as identified in the specification denotes not only the rotors or the rotor 1' but also to the casing or the housing 1''. A suction filter 4 which opens to the atmosphere or source of gas to be compressed is connected through an electromagnetic valve 3 (explained hereinafter in detail) to a suction side of the compressor member 1. A discharge circuit 5 extends from a discharge side of the compressor member 1 to open in the oil tank 6 and above the level of the oil in the oil tank 6. An oil separator 7 is incorporated in the oil tank 6 and is located above the oil level in the oil tank 6. The oil separator 7 is connected through a conduit 9 with a storage tank 8 for the compressed gas. In the conduit 9 there are sequentially from the side of the oil separator 7 a pressure retaining valve 10 and a check valve 11. An oil pipe 12 extends from the bottom portion of the oil tank 6 to the suction side of the compressor member 1, and includes sequentially from the side of the oil tank 6 a temperature regulating valve 13, an oil cooler 14 and an oil filter 15. A by-pass conduit 16 by-passing the oil cooler 14 is connected to the temperature regulating valve 13 and to the downstream side of the oil cooler 14. The downstream side of the oil filter 15 is connected with the oil separator 7 through an oil returning pipe 18 having a throttling member 17.

A pressure switch 19 connected to the storage tank 8 is actuatable in response to the pressure of the gas in the storage tank 8. The pressure switch 19 is of a type which is normally closed and opens at a predetermined high pressure $P_1$ and close again at a predetermined return pressure $P_1'$ wherein $P_1 > P_1'$. A release valve 20 is connected to the oil tank 6 to release the pressure therein, and the release valve 20 may be an electromagnetic valve which is normally open and closes when energized. Further, a first temperature detector 21 according to the invention is provided in the oil tank 6 to detect the oil temperature.

The electromagnetic valve 3 housing a coil 3' provided in the suction side of the compressor member 1 is connected also with the interior of the oil tank 6 through a conduit 22, so that the valve 3 can selectively connect the suction side of the compressor member 1 with the suction filter 4 (and accordingly with the atmospheric air or other source of gas to be compressed), or with the interior of the oil tank 6. When the pressure in the oil tank 6 exceeds a predetermined pressure $P_2$ which is higher than the pressure $P_1$ that actuates the pressure switch 19, the valve 3 is by pressure switch 31 to connect the suction side of the compressor member 1 with the interior of the oil tank 6. The valve 3 returns to the initial condition to connect the suction side of the compressor member 1 with the suction filter 4 when the pressure in the oil tank 6 decreases to a predetermined return pressure $P_2'$ which is lower than the pressure $P_2$ and is higher than the actuating pressure $P_1$ of the pressure switch 19. Thus, the relationship between these pressures is $P_1' < P_1 < P_2' < P_2$.

A second temperature detector 23 according to the invention is provided adjacent to the suction filter 4 to detect the temperature of the gas being sucked into the compressor member 1 or the room temperature.

The first and second temperature detectors 21 and 23 cooperate with the pressure switch 19 to control the operation of the motor 2, and to control the release valve 20 in response to the operation of the motor 2.

Figure 2:
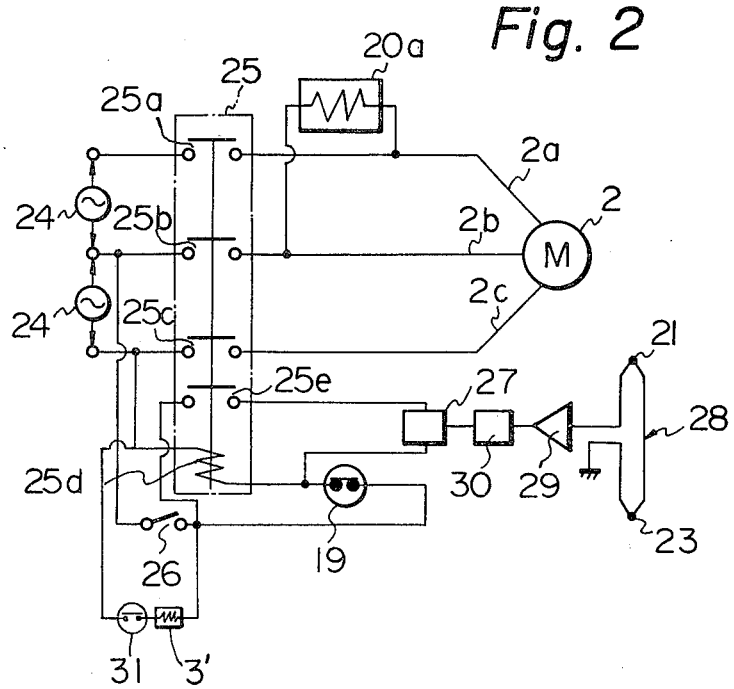
FIG. 2 is a diagram of an electric circuit for controlling the motor of FIG. 1.

FIG. 2 shows one example of a wiring diagram connecting the motor 2, the pressure switch 19, the release valve 20 and the temperature switches 21 and 23. In FIG. 2, the motor 2 is 3-phase AC type with the first, second and third lines **2*a*, 2*b* and 2*c* being connected with the power source 24 through normally open contacts 25*a*, 25*b* and 25*c* of an electromagnetic switch 25, respectively. Between the contacts 25*c* and 25*b* and the power source 24, the main switch 26, the pressure switch 19 and a coil 25*d* of the electromagnetic switch 25 are connected in series. A self retaining contact 25*e* is provided for the electromagnetic switch 25 and is connected in series with a relay 27 to by-pass the pressure switch 19. The relay 27 is controlled through an amplifier 29 and a comparator 30 depending on the electromotive force of a thermo-couple 28 which consists of the first and second temperature detectors 21 and 23. Between the first and second lines 2*a* and 2*b* of the motor 2 and on the downstream side of the electromagnetic switch 25, a coil 20*a* of the release valve 20 is connected. Incidentally, the relay 27 opens when the electromotive force of the thermo-couple 28 is large, i.e. when the difference between the temperature detectors 21 and 23 is larger than a predetermined value $T_o$ such as 50°, and the relay 27 closes when the electromotive force of the thermo-couple 28** is small.

Operation of the embodiment will now be explained. Firstly, it is assumed that the temperature of the oil in the oil tank 6 is approximately equal to the room temperature, and that the storage tank 8 is empty. Since the pressure switch 19 is closed, the coil **25*d* of the electromagnetic switch 25 is energized to close the contacts 25*a*, 25*b* and 25*c* by closing the main switch 26. Thus, the motor 2 is started, and the coil 20*a* is energized to close the release valve 20. The compressor member 1 sucks through the filter 4 the gas to be compressed e.g. the atmospheric air, and also the oil from the oil tank 6. It will be noted that the valve 3 is not actuated, so the suction side of the compressor member 1 is connected with the filter 4. The compressor member 1 performs the compressing action, and the gas compressed is discharged into the upper portion of the oil tank 6 together with the oil being heated by the compression heat, and the oil is separated from the gas in the oil separator 7. The gas is introduced into the storage tank 8, and the oil separated from the gas is collected in the oil tank 6 and is reused through the oil pipe 12 to cool and lubricate the compressor member 1. When the temperature of the oil in the oil tank 6 is relatively low, the oil in the oil pipe 12 by-passes the oil cooler 14**.

By continuing the operation, the oil temperature in the oil tank 6 increases and the pressure in the tanks 6 and 8 also increases. When the pressure in the tanks 6 and 8 increases to the pressure $P_1$, the pressure switch 19 opens. however, when the difference between the oil temperature and the room temperature is smaller than the predetermined temperature $T_o$, the relay 27 is maintained closed. Since the self-retaining switch **25*e* is also closed, the motor 2 continues to be energized and the pressure in the storage tank 8** increases further.

When the pressure in the oil tank 6 reaches the predetermined pressure $P_2$, the pressure switch 31 energizes coil 3' to open the electro-magnetic valve 3 to connect the suction side of the compressor member 1 with the oil tank 6, consequently, the compressor member 1 operates in a closed circuit operation with the pressure in the tanks 6 and 8 being substantially maintained at $P_2$. The oil temperature increases at a high rate since the energy for operating the motor is connected solely into heat.

When the oil temperature increases such that the difference between the temperatures detected by the detectors 21 and 23 exceeds the predetermined value $T_o$, the relay 27 opens, thereby stopping the power supply to the motor 2 and, as a result, the release valve 20 opens and the pressure in the oil tank 6 is released.

When the pressure in the storage tank 8 decreases to the pressure $P_1'$ by consuming the compressed gas in the storage tank 8, the pressure switch 19 closes to start the motor 2. Since the oil temperature has sufficiently to suppress the generation of drain water, the operation of the motor 2 is controlled solely by the pressure switch 19 acting between the pressures $P_1$ and $P_1'$.

The above describes the operation of the invention when the pressure in the tanks 6 and 8 increases to the pressure $P_2$ with the difference between the oil temperature and the room temperature being less than $T_o$. However, when the temperature difference exceeds $T_o$ with the pressure in the tanks 6 and 8 being higher than $P_1$ and less than $P_2$, then, the relay 27 acts to stop the operation of the motor 2, the pressure in the tanks 6 and 8 will not increase further and, thereafter, the pressure responsive operation of the motor 2 is performed by the pressure switch 19. In such case the time of the oil temperature elevating operation or the unload operation of the motor 2 can be reduced.

Figure 3:
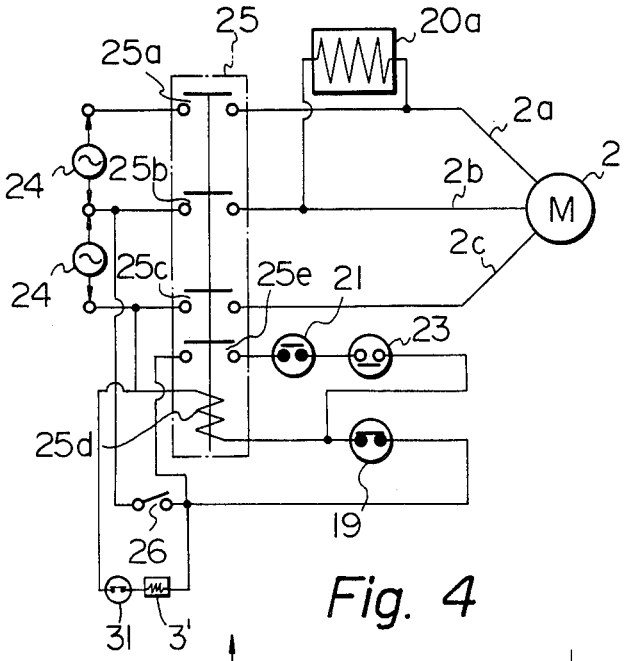
FIG. 3 is an electric circuit diagram showing another embodiment of the invention.
Figure 4:
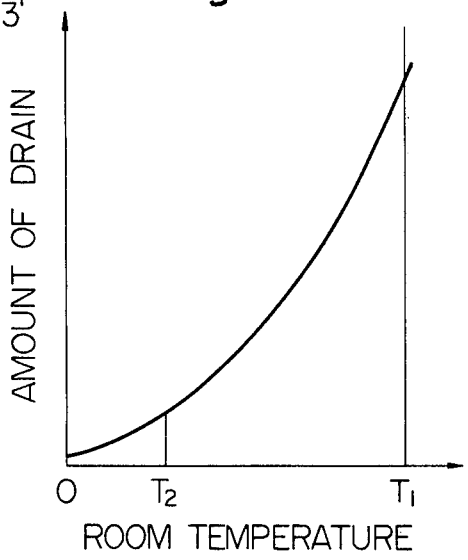
FIG. 4 is a graph showing the relationship between the room temperature and the quantity of drain water.

FIG. 3 shows a wiring diagram of another embodiment of the present invention. In the embodiment, the first temperature detector 21 is a switch of the type which is a normally closed and which closes at a predetermined temperature $T_3=T_1+T_0$ wherein $T_1$ is the maximum room temperature in the normal operating condition e.g. about 40° C., and $T_0$ is the predetermined temperature difference for suppressing the generation of the drain water when the room temperature is at a maximum level, e.g. 50° C. The second temperature detector 23 is a switch which opens when the temperature exceeds a predetermined low temperature $T_2$ at which the generation of the drain water is very low since the absolute humidity is very low, as shown in FIG. 4 (e.g. about 10° C.), and closes and opens when the temperature is below $T_2$. The detectors 21 and 23 are connected in series with the self retaining contact 25*e* of the electromagnetic switch 25. Thus, in the embodiment, when the room temperature is lower than $T_2$ or the oil temperature is higher than $T_3$, the operation of the motor 2 is controlled solely by the pressure switch 19 that is, the pressure responsive operation of the compressor is performed. When the room temperature is higher than $T_2$ and the oil temperature is lower than $T_3$, the oil temperature elevating operation of the compressor performed with the pressure in the tanks 6 and 8 being substantially prevented from exceeding the predetermined pressure $P_2$ by the action of the valve 3.

In the embodiments, the valve 3 or a change over valve is utilized to control the pressure in the tanks 6 and 8 during the oil temperature elevating operation of the compressor. However, the change over valve 3 may be replaced by a suction throttling valve. Alternatively, a release valve may be provided in the tank 6 or in the tank 8 to release a portion of the compressed gas to the outside. Further, in the embodiments, the gas to be compressed is atmospheric air, and the second temperature detector detects the room temperature. However, the invention may be applied to compressors compressing any suitable gas.

It will be appreciated from the foregoing that, according to the invention, it is possible to minimize the operation time of oil temperature elevating of the compressor and to prevent the generation of drain water.

What is claimed is:

1. An oil-cooled compressor, comprising:

a compressor member, having a suction side and a discharge side, for compressing a gas to be compressed, said compressor member having means for drawing said gas to be compressed from a source into said suction side and discharging compressed gas from said discharge side;

a motor for driving said compressor member;

an oil tank having an oil separator for removing oil from the compressed gas discharged from said discharge side of said compressor member, coupled to said discharge side of said compressor member;

means, responsive to the temperature of said oil, the temperature of said gas to be compressed and the pressure of said discharged gas, for turning the motor off only when the difference between the temperature of said oil and the temperature of said gas to be compressed exceeds a predetermined temperature difference and the pressure of the discharged gas exceeds a first predetermined pressure; and means, responsive to the pressure of said discharged gas, for throttling said discharged gas in a closed path communicating with said suction side of said compressor member when the pressure of said discharged gas is within a pressure range higher than said first predetermined pressure, whereby said discharged gas and said oil are heated by the operation of said compressor member.

2. An oil-cooled compressor as in claim 1, wherein said throttling means includes means, disposed in said closed path and responsive to the pressure of said discharged gas, for closing said closed path to permit throttling of said discharged gas therein only when the pressure of said discharged gas is at least equal to a second predetermined pressure greater than said first predetermined pressure and said temperature difference does not exceed said predetermined temperature difference.

3. An oil-cooler compressor as in claim 1, wherein said motor turning off means comprises a thermocouple including a first temperature detector for detecting the temperature of said oil and a second temperature detector for detecting the temperature of said gas to be compressed, said thermocouple producing a signal indicative of said temperature difference; a circuit adapted when completed to energize said motor, said circuit including means, including a first pressure switch, connected in said circuit and responsive to the pressure of said discharged gas, and means for coupling said thermocouple to said circuit, for interrupting said circuit to turn off said motor when said temperature difference exceeds said predetermined temperature difference and the pressure of said discharged gas exceeds said first predetermined pressure, whereby heating of said discharged gas and said oil is discontinued when said temperature difference reaches said predetermined temperature difference.

4. An oil-cooled compressor as in claim 3, wherein said throttling means includes a two position valve having alternative first and second positions respectively coupling said suction side to said source, or to said oil tank in said closed path; and second pressure switch means, responsive to the pressure of said discharged gas for moving said two position valve into said second position when the pressure of said discharged gas reaches said second predetermined pressure.

5. An oil-cooled compressor, comprising:

a compressor member, having a suction side and a discharge side, for compressing a gas to be compressed, said compressor member further having means for drawing said gas to be compressed from a source into said suction side and discharging compressed gas from said discharge side;

a motor for driving said compressor member;

an oil tank, coupled to said discharge side of said compressor member, having an oil separator for removing oil from compressed gas discharged from said compressor member;

means, responsive to the temperature of said oil, the temperature of said gas to be compressed and the pressure of said discharged gas, for turning the motor off only when the pressure of said discharged gas exceeds a first predetermined pressure, and either the temperature of said gas to be compressed exceeds a first predetermined temperature or the temperature of the air to be compressed is lower than a second predetermined temperature; and means, responsive to the pressure of said discharged gas, for throttling said discharged gas in a closed path communicating with said suction side of said compressor member.

6. An oil-cooled compressor as in claim 5, further comprising a circuit adapted when completed to energize said motor, said motor turning off means comprising first and second temperature switches connected in said circuit, respectively responsive to the temperature of said oil and the temperature of said gas to be compressed, and a first pressure switch, connected in said circuit and responsive to the pressure of said discharged gas, for interrupting said circuit to turn off said motor when the temperature of said gas to be compressed is lower than said second predetermined temperature, the temperature of said oil is higher than said second predetermined temperature, and the pressure of said discharged gas exceeds said first predetermined pressure.

7. An oil-cooled compressor as in claim 6, wherein said throttling means includes means for throttling said discharged gas in said closed path when the pressure of said discharged gas exceeds a second predetermined pressure higher then said first predetermined pressure; said throttling means further comprising means, disposed in said closed path and responsive to the pressure of said discharged gas, for closing said discharge path to permit throttling of said discharged gas therein, said closing means including a two position valve having alternative first and second positions respectively coupling said suction side to said source or to said oil tank in said closed path, and a second pressure switch, responsive to the pressure of said discharged gas, for moving said two position valve into said second position when the pressure of said discharged gas reaches said second predetermined pressure, whereby said discharged gas and said oil are heated by said compressor member so that the temperature of said oil increases to said second predetermined temperature.

8. An oil-cooled compressor as in claim 4 or claim 7, further comprising relief valve means, responsive to the operation of said motor, for opening said closed path to release the pressure in said oil tank when said motor is turned off.

9. An oil-cooled compressor as in claim 5, wherein the difference between said first and second predetermined temperature is approximately 50° C.

10. An oil-cooled compressor as in claim 1 or claim 5, wherein said gas to be compressed comprises atmospheric air.

* * * * *